US005423619A

United States Patent [19]

Kohno

[11] Patent Number: 5,423,619

[45] Date of Patent: Jun. 13, 1995

[54] CARD PRINTING APPARATUS

[75] Inventor: Nobuo Kohno, Kanagawa, Japan

[73] Assignee: Sony Corporation, Japan

[21] Appl. No.: 127,598

[22] Filed: Sep. 28, 1993

[30] Foreign Application Priority Data

Sep. 30, 1992 [JP] Japan ..... 4-261682

[51] Int. Cl.[6] ..... B41J 13/10

[52] U.S. Cl. ..... 400/525; 400/73; 400/628; 271/131

[58] Field of Search ..... 400/73.48, 525, 527.1, 400/530, 539, 542, 543, 624, 628; 271/131, 132

[56] References Cited

U.S. PATENT DOCUMENTS

| | | | |
|---|---|---|---|
| 3,960,373 | 6/1976 | Pacholok | 271/131 |
| 4,054,198 | 10/1977 | Kwan | 400/535 |
| 4,149,723 | 4/1979 | Simon | 273/95 |
| 4,238,125 | 12/1980 | Klietz | 271/131 |
| 4,457,665 | 7/1984 | Fluck | 414/786 |
| 4,507,668 | 3/1985 | Horiya et al. | 346/76 |
| 4,619,197 | 10/1986 | Pailler | 400/605 |
| 4,743,129 | 5/1988 | Keryhuel et al. | 400/582 |
| 4,812,060 | 3/1989 | Pailler | 400/605 |
| 4,828,406 | 5/1989 | Mosciatti et al. | 400/48 |
| 5,135,321 | 8/1992 | Olsen et al. | 400/605 |
| 5,199,699 | 4/1993 | Murad et al. | 271/131 |

FOREIGN PATENT DOCUMENTS

| | | | |
|---|---|---|---|
| 0558419 | 2/1993 | European Pat. Off. | 400/525 |
| 0060283 | 5/1981 | Japan | 400/535 |
| 0233571 | 10/1986 | Japan | 400/521 |
| 62-11370 | 1/1987 | Japan . | |
| 64-53943 | 3/1989 | Japan . | |
| 2186844 | 8/1987 | United Kingdom | 400/521 |

*Primary Examiner*—Edgar S. Burr
*Assistant Examiner*—John S. Hilten
*Attorney, Agent, or Firm*—Ronald P. Kananen

[57] ABSTRACT

When a magnetic head is fed in one direction by a card stage, ID information recorded in a magnetic stripe on a lowermost one of vertically stacked cards in a card stock unit is read by the magnetic head. Then, the lowermost card is carried by the card stage and fed in an opposite direction toward a printing unit, which prints image information on the card on the card stage based on the ID information that has been read by the magnetic head. This arrangement allows a complete match to be achieved between the ID information recorded in the magnetic stripe and the image information printed on the card.

16 Claims, 12 Drawing Sheets

CARD PRINTING APPARATUS

BACKGROUND OF THE INVENTION

1. Field of the Invention

The present invention relates to a card printing apparatus for printing various pieces of information including the name of a person, the name of a company, etc., on a magnetic card, thus producing an identification (ID) card.

2. Description of the Prior Art

There has heretofore been proposed a card printing apparatus having a thermal transfer head for printing a color image on a card based on color image information optically read from a color photograph or color image information electrically produced by a video camera, as disclosed in Japanese laid-open patent publication No. 62-11370.

In the conventional card printing apparatus, an ink ribbon is heated and pressed against the card by the thermal transfer head, and the card is translated by a stage to thermally transfer a printing color material from the ink ribbon to the card. Such a printing process is repeated to thermally transfer a plurality of desired printing color materials such as of cyan, magenta, yellow, and blacks from the ink ribbon based on the color image information. The desired printing color materials are thus successively superimposed on the card, thereby printing a color image on the card.

Generally, the card on which such a color image is printed comprises a magnetic card. Specifically, the magnetic card is printed with an image such as a photograph of the face of a person, including letters, numerals, and symbols representing the name of the person and other information. On the magnetic card, there is magnetically recorded ID information including the name, the birth date, and the password number of the person, in the form of a magnetic stripe by a magnetic encoder.

The magnetic card with such a magnetic stripe in which the information is magnetically recorded is usually referred to as an ID card.

The ID card is required to have a complete match between the information recorded in the magnetic stripe and the image printed on the card.

Two control processes have heretofore been employed to ensure such a complete match between the recorded information and the printed image. One control process is a manual control process for manually verifying the match between the image that is printed by a card printing apparatus and the information that is recorded by a magnetic encoder which is separate from the card printing apparatus. The other control process is an automatic control process in which the match is automatically verified by a card printing apparatus and a magnetic encoder that are connected to each other in an online network.

The manual control process is however problematic in that the manual verification is subject to errors and requires a relatively long period of time to carry out. The on-line system for effecting the automatic verification is relatively large and expensive.

OBJECTS AND SUMMARY OF THE INVENTION

It is therefore an object of the present invention to provide a card printing apparatus capable of reliably verifying, with a simple arrangement, a match between information recorded in an information recording area such as a magnetic stripe in a card and an image printed on the card by a printer.

According to the present invention, there is provided a card printing apparatus for printing image information on a surface of a card, comprising a card stage for supporting the card on an upper surface thereof, card stock means for stocking a plurality of cards, feeding means for feeding the card stage at least between a first position to withdraw one of the cards at a time from the card stock means and a second position to print the image information on the surface of the card, along a straight path parallel to the surface of the card, withdrawing means responsive to the feeding of the card stage for withdrawing the one of the cards from the card stock means onto the card stage, reading means responsive to the feeding of the card stage for reading information recorded on the one of the cards, and printing means responsive to the feeding of the card stage for printing the image information on the surface of the one of the cards supported on the card stage based on the information read from the one of the cards by the reading means.

The card stock means may comprises means for stocking a vertical stack of cards. The reading means may comprise means for reading information recorded on the lowermost one of the cards. The card printing apparatus may further comprise a slider movable along the straight path for supporting the lowermost one of the cards in the card stock means before the card stage is in the first position.

The reading means may be mounted on the slider, and may comprise a magnetic head.

Alternatively, the reading means is mounted on the card stock means, and may comprise a magnetic head.

The printing means may comprise a thermal transfer head.

According to the present invention, there is also provided a card printing apparatus for printing first information on a card based on second information recorded on the card, comprising card stock means for storing a stack of cards, printing means spaced from the card stock means for printing first information on a card, card carriage means movable along a linear path for carrying a card from the card stock means to the printing means, card withdrawing means responsive to movement of the card carriage means for withdrawing one of the cards at a time from the card stock means to the card carriage means reading means responsive to movement of the card carriage means for reading second information recorded on the one of the cards, and control means for supplying the second information read from the one of the cards to the printing means and controlling the printing means to print first information on the one of the cards on the card carriage means based on the second information read from the one of the cards.

The card withdrawing means may comprise means for withdrawing a lowermost one of the cards from the card stock means to the card carriage means. The card printing apparatus may further comprise a slider movable along the linear path for supporting the lowermost one of the cards in the card stock means while the reading means is reading the second information recorded on the lowermost one of the cards in the card stock means.

The first information may comprise image information and the second information may comprise information magnetically recorded on the cards.

The printing means may comprise a thermal transfer head.

The above and other objects, features, and advantages of the present invention will become apparent from the following description of illustrative embodiments thereof to be read in conjunction with the accompanying drawings, in which like reference numerals represent the same or similar objects.

DETAILED DESCRIPTION OF THE PREFERRED EMBODIMENTS

Figure 1:
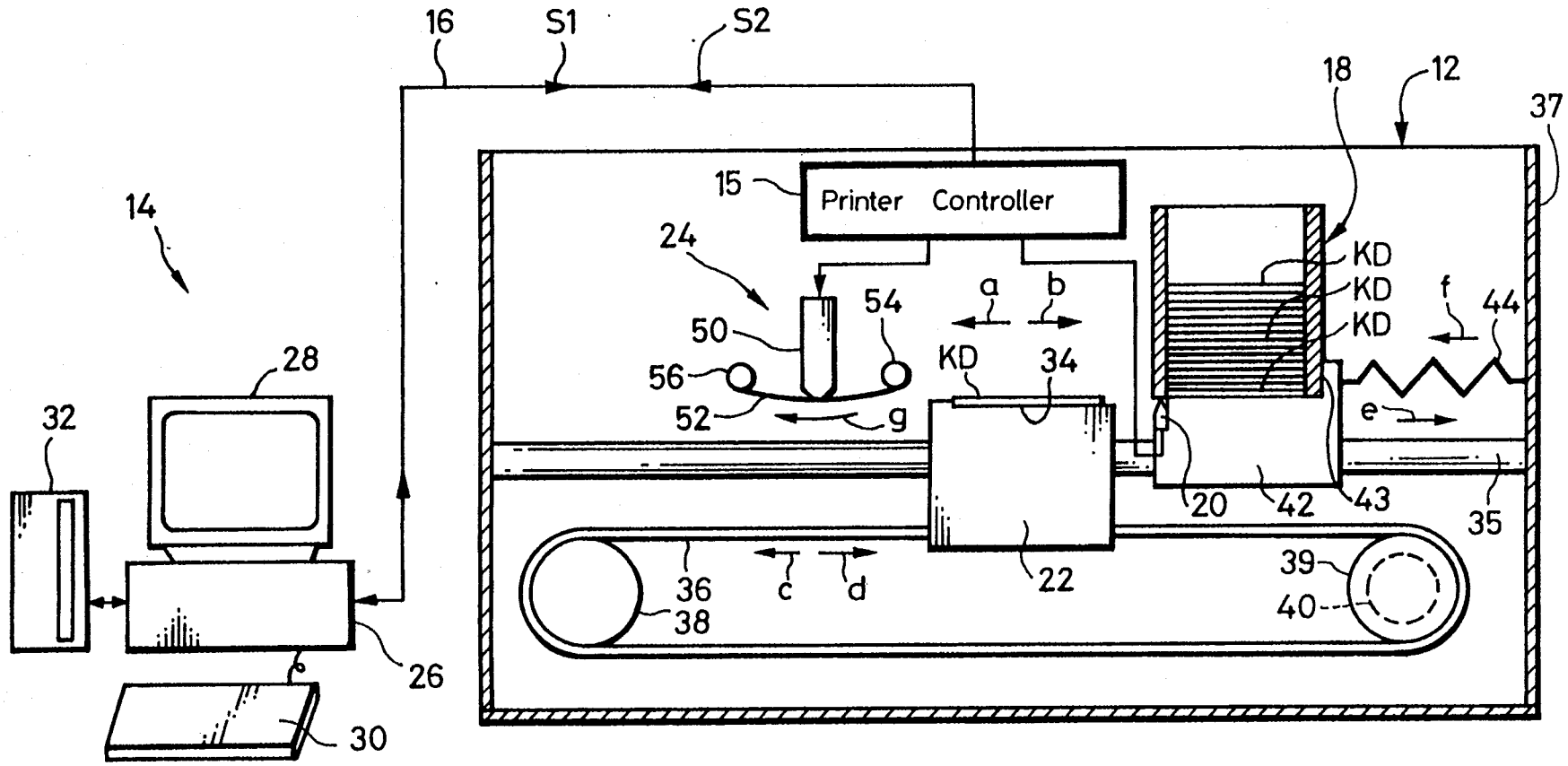
FIG. 1 is a sectional side elevational view of a card printing apparatus according to an embodiment of the present invention.

As shown in FIG. 1, a card printing apparatus according to an embodiment of the present invention generally comprises a video printer 12 and a host computer 14 serving as a main control means which is connected to the video printer 12 by an interface cable 16.

The host computer 14 comprises a computer unit 26, a monitor 28 such as a CRT connected to the computer unit 26, an input device 30 such as a keyboard connected to the computer unit 26, and an external storage unit 32 such as a magnetooptical disk drive connected to the computer unit 26.

The video printer 12 basically comprises a card stock unit (card stock means) 18 for storing a vertical stack of cards KD, a magnetic head (reading means) 20 as a card reader, a card stage 22, a printing unit (printing means) 24, and a printer controller 15 as a control means for interfacing the video printer 12 and the host computer 14 to control primarily operation of the printing unit 24.

Figure 8:
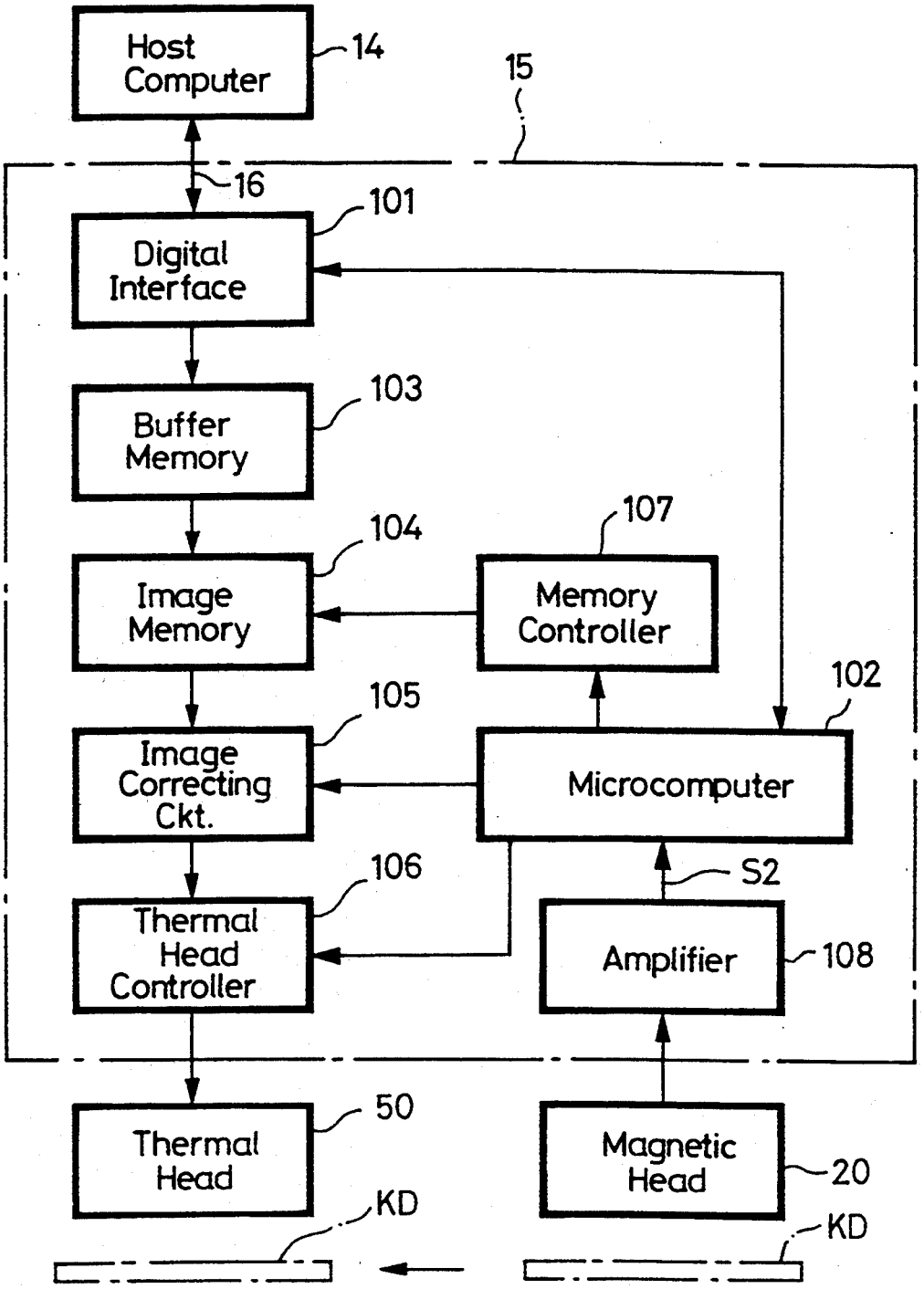
FIG. 8 is a block diagram of a printer controller of the card printing apparatus shown in FIG. 1.

The printer controller 15 is shown in detail in FIG. 8. As shown in FIG. 1, the printer controller 15 has a digital interface 101 such as a SCSI or the like connected to the host computer 14 by the interface cable 16, and a one-chip microcomputer 102 connected to the digital interface 101. The microcomputer 102 comprises a CPU, a ROM, a RAM, and an interface. ID information S2 belonging to a certain card KD is read by the magnetic head 20, amplified by an amplifier 103, and decoded by the microcomputer 102. The decoded ID information is then transmitted from the microcomputer 102 through the digital interface 101 to the host computer 14.

The host computer 14 reads image data which matches the ID information sent from the microcomputer 102 from the external storage unit 32 (see FIG. 1), and transmits the image data through the digital interface 101, a buffer memory 103, an image memory 104, an image correcting circuit 105, and a thermal head controller 106 to a thermal head 50. The microcomputer 102 controls a memory controller 107 which controls reading of data from and writing of data in the image memory 104, the image correcting circuit 105, and the thermal head controller 106. The thermal head 50 prints desired a desired image on the card KD.

In FIG. 1, the card stage 22 in the video printer 12 has a card base 34 for securely holding thereon a single magnetic card KD. While securing supporting the card KD, the card stage 22 is translated along two parallel guide shafts 35 (see FIG. 2) in the direction indicated by the arrow a or the opposite direction indicated by the arrow b, by a belt 36 fixed to the card stage 22 as the belt 36 moves in the direction indicated by the arrow c (parallel to the direction a) or the opposite direction indicated by the arrow d (parallel to the direction b). The guide shafts 35 have opposite ends fixed to opposite end walls of a casing 37 of the video printer 12.

The belt 36 is trained around two rollers 38, 39 spaced from each other. The roller 39 is coaxially coupled to the output shaft of a reversible motor 40. When the motor 40 is energized, therefore, the card stage 22 moves in the direction a or b. The rotation of the motor 40 and the position of the card stage 22 are controlled by the microcomputer 102 which is electrically connected to the motor 40 by wires (not shown), and a plurality of position sensors, e.g., limit switches or photosensors, which are electrically connected to the motor 40 by wires (not shown) and located at intervals along the guide shafts 35.

With respect to the guide shafts 35, it is assumed that the roller 39 is positioned upstream of the roller 38 and hence the roller 38 is positioned downstream the roller 38.

A slider (sliding means) 42 serving as the bottom plate of the card stock unit 18 for supporting the lowermost card KD in the card stock unit 18 is positioned underneath the card stock unit 18 upstream of the card stage 22. The magnetic head 20 is attached to the downstream end of the slider 42. When the slider 42 engaged by the upstream end of the card stage 22 is pushed by the card stage 22 in the direction indicated by the arrow e (which is the same as the direction b and oriented upstream), the slider 42 moves in unison with the card stage 22 along the guide shafts 35. The slider 42 is normally urged to move downwardly in the direction indicated by the arrow f by a compression spring 44. When not engaged by the card stage 22, a shoulder 43 of the slider 42 at its upstream end is held against the upstream side wall of the card stock unit 18, thus holding the card stock unit 18 in position as shown in FIG. 1. The card stock unit 18 is fixed to the casing 37 by a fixing member (not shown).

The printing unit 24 is positioned downstream of the stage 22 and fixed to the casing 37 by a fixing member (not shown). The printing unit 24 basically comprises a thermal transfer head 50 and an ink ribbon 52.

Figure 2:
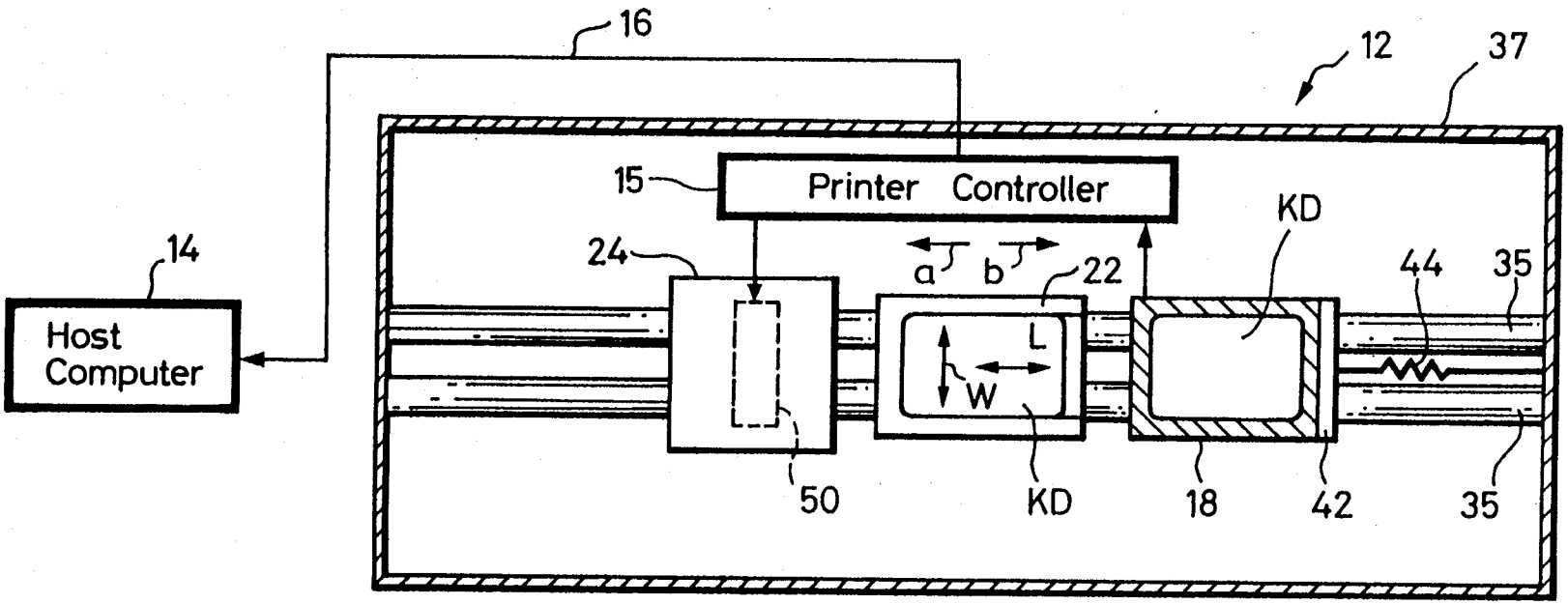
FIG. 2 is a sectional plan view of the card printing apparatus shown in FIG. 1.

As shown in FIG. 2, the thermal head 50 has its heating array extending parallel to the width W of the card KD. As shown in FIG. 1, the ink ribbon 52 is intermittently fed from a supply reel 54 to a takeup reel 56 in the direction indicated by the arrow g.

Figure 9:
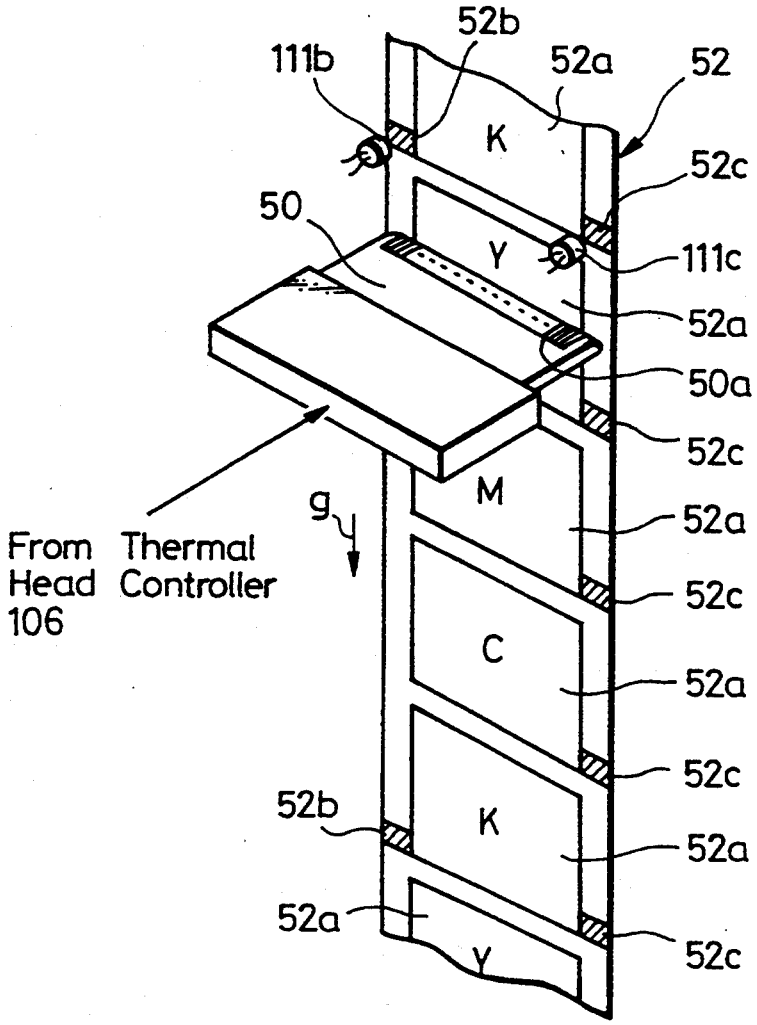
FIG. 9 is a fragmentary perspective view showing an ink ribbon and a thermal head of the card printing apparatus shown in FIG. 1.

As shown in FIG. 9, the ink ribbon 52 has a plurality of color frames 52*a* spaced at equal intervals and coated with printing color materials, i.e., sublimable dyes, such as of yellow Y, magenta M, cyan C, and black K in the direction g. When the ink ribbon 52 is intermittently fed from the supply reel 54 to the takeup reel 56, these color frames 52*a* are successively fed to the thermal head 50. The ink ribbon 52 has a plurality of block markers 52*b* on one longitudinal marginal edge thereof which indicate the positions of respective color blocks each containing yellow Y, magenta M, cyan C, and black K, and a plurality of color markers 52*c* on the opposite longitudinal marginal edge thereof which indicate the positions of respective color frames 52*a*. These color marks 52*c* and block marks 52*b* can be detected by photosensors 111*c*, 111*b*, which supply detected electric signals to the microcomputer 102 through wires (not shown).

In synchronism with the intermittent feeding of the ink ribbon 52 under the control of the microcomputer 102, the card KD on the card stage 22 is moved in the direction a or b and printed with a color image such as the photograph of a face by the thermal head 50 based on printing information S1. The heating array of the thermal head 50 comprises an array of as many heating elements 50*a* as the number of pixels across an image to be printed on the card KD, the heating elements 50*a* being positioned on the tip of the thermal head 50. The heating elements 50*a* are supplied with a succession of planar sequential color signals representing yellow Y, magenta M, cyan C, and black K from the thermal head controller 106 (see FIG. 8).

The color printing with the thermal head 50 is controlled by the microcomputer 102 according to a control program based on the printing information S1 supplied from the host computer 14 through the interface cable 16. The printing information S1 is usually stored in the external storage unit 32.

The card stage 22 and related mechanisms will be described below with reference to FIGS. 10 through 12.

Figure 10:
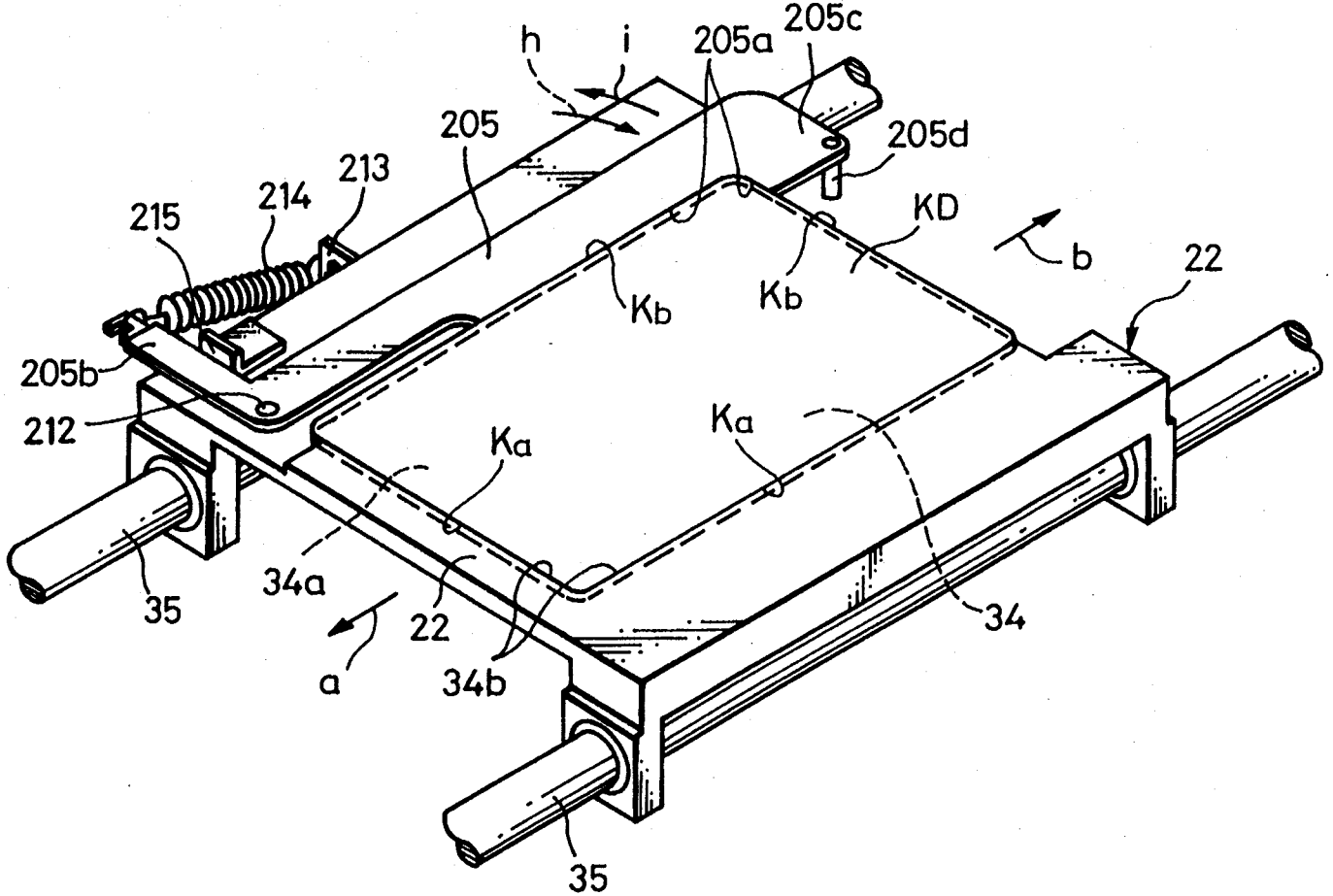
FIG. 10 is a perspective view of a card stage of the card printing apparatus shown in FIG. 1.

As shown in FIG. 10, the card stage 22 has a card installing arm 205 for removably holding the lowermost one of the cards KD stacked in the card stock unit 18 on the card base 34 on the upper surface of the card stage 22. The card base 34 has a horizontal card support surface 34*a* including perpendicular reference corner edges 34*b* for engaging and positioning first two perpendicular side edges Ka of the card KD.

The card installing arm 205 is in the form of a plate having substantially the same thickness as the card KD and has a substantially crank shape when viewed in plan. The car holder arm 205 is pivotally mounted on the card stage 22 by a vertical pivot pin 212 for rotation in the directions indicated by the arrows h, i. The card installing arm 205 has perpendicular card engaging edges 205*a* that are diagonally opposite to the reference corner edges 34*b* for engaging and positioning second two perpendicular side edges Kb of the card KD. The card installing arm 205 is normally urged to turn about the pivot pin 212 in the direction h by a tension coil spring 214 that is coupled between a free end 205*b* thereof and a spring retainer 213 on a side of the card stage 22, so that the card installing arm 205 is held against a stopper 215 on the card stage 22 with the card engaging edges 205*a* lying parallel to the side edges Kb of the card KD. A vertical guide pin 205*d* is mounted on a lower surface of a distal end 205*c* of the card installing arm 205 remote from the pivot pin 212.

Figure 11:
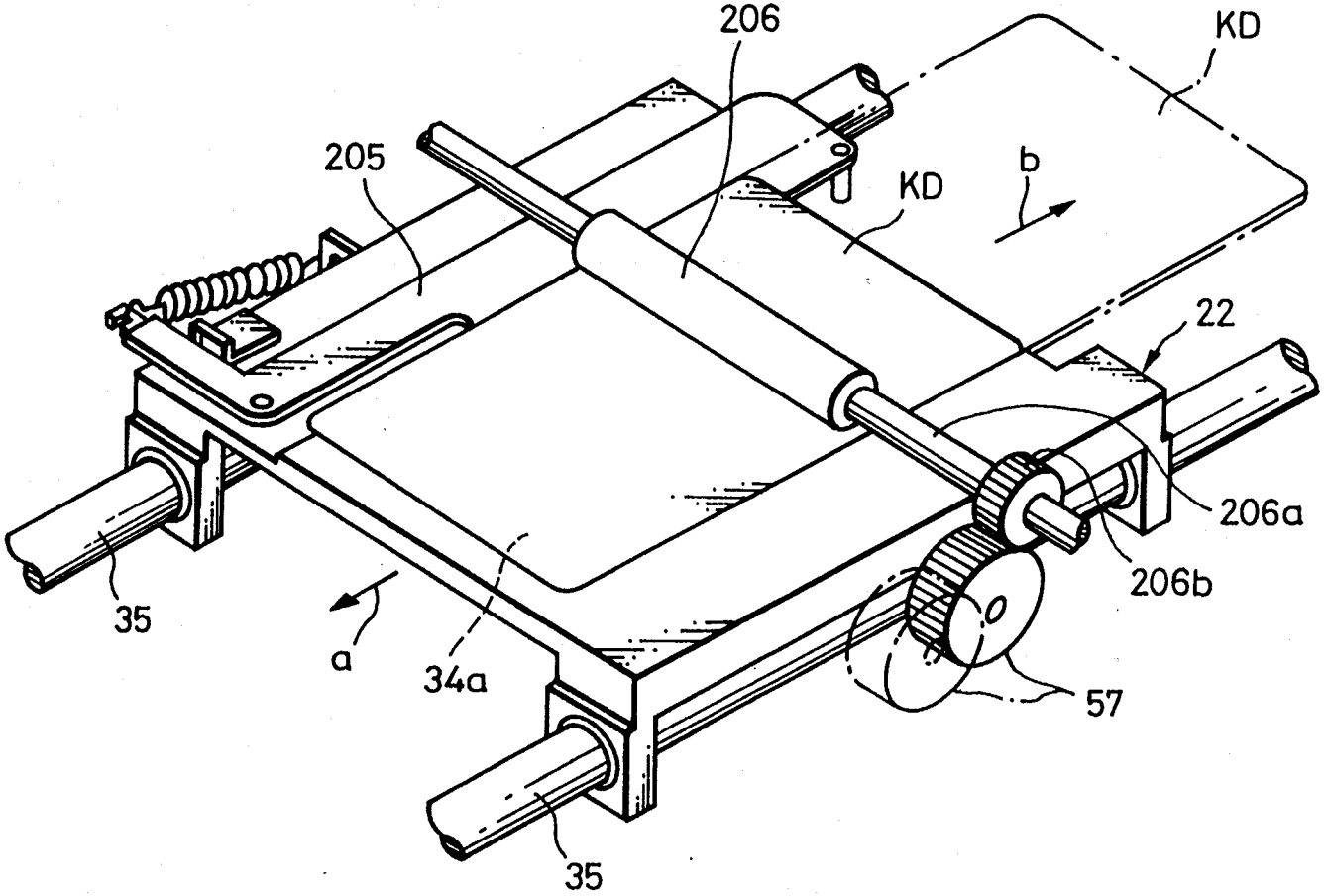
FIG. 11 is a perspective view of the card stage with a card presser roller.
Figure 12:
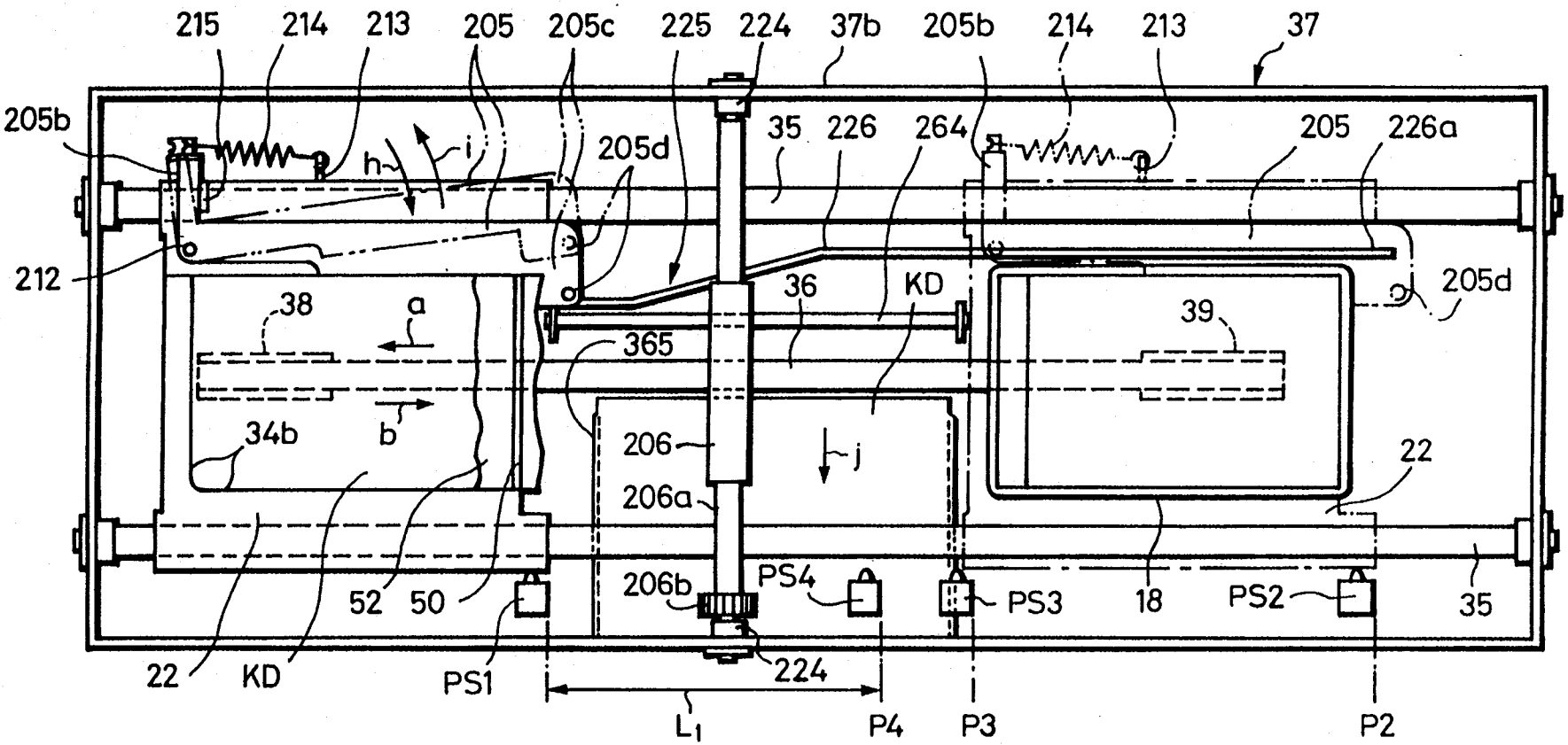
FIG. 12 is a fragmentary plan view of a mechanical arrangement of the card printing apparatus shown in FIG. 1.

As shown in FIGS. 11 and 12, the card KD is resiliently pressed against the card support surface 34*a* of the card stage 22 at all times by a card holder roller 206 so as to be prevented from accidentally falling off the card stage 22 while the card KD is being printed.

FIG. 12 illustrates the position sensors for detecting the position of the card stage 22. Specifically, four position sensors PS1~PS4 are disposed respectively in an original position P1, a card installing position P2, a card printing position P3, and a card discharging position P4 for detecting the position of a substantially upstream end of the card stage 22. Output signals from the position sensors PS1~PS4 are supplied through the non-illustrated wires to the microcomputer 102. The slider 42 is omitted from illustration in FIG. 12 for the sake of brevity.

As shown in FIG. 12, the card holder roller 206 is horizontally positioned perpendicularly to the guide shafts 35 in the straight path of movement of the card stage 22 substantially centrally in a card printing interval L1 between the original position P1 and the card printing position P3. The card holder roller 206 is made of a resilient material having a relatively large coefficient of friction, such as rubber or the like. The card holder roller 206 is fixedly disposed around a horizontal roller shaft 206*a* that is rotatably supported on a pair of laterally spaced side walls 37*b* of the casing 37 by respective bearings 224. A gear 206*b* is fixed to one end of the roller shaft 206*a*. When the card KD is printed or at other times than when the card KD is discharged, a stop gear 57 is positioned in a dot-and-dash-line position shown in FIG. 11 out of mesh with the gear 206*b*, thus allowing the gear 206*b* to rotate freely. When the card holder roller 206 is freely rotatable, the card holder roller 206 can prevent the card KD from falling off the card stage 22 and also permits the card KD to be peeled off the ink ribbon 52 when the card KD is printed.

As shown in FIG. 12, a guide mechanism 225 is positioned near one of the guide shafts 35 for guiding the guide pin 205*d* to angularly move the card installing arm 205 in the directions h, i. The guide mechanism 225 comprises a guide rail 226 extending along the path of movement of the guide pin 205*d* in the directions a, b, between the original position P1 and the card installing position P2.

As the card stage 22 is fed from the original position P1 upstream in the direction b, the guide pin 205*d* is displaced in the direction i by a curved configuration of the guide rail 226. When the card stage 22 reaches the card installing position P2, the guide pin 205*d* runs off a right-hand end 226*a* of the guide rail 226, and is displaced back in the direction h. At this time, the lowermost card KD in the card stock unit 13 is installed on the horizontal support surface 34*a* of the card base 34 of the card stage 22. Thereafter, the card stage 22 is fed downstream in the direction b, during which time the card KD is printed by the printing unit 24. While the card KD is being printed, the card installing arm 205 is in the position shown in FIG. 11, thereby holding the card KD on the card stage 22.

After being printed, the card KD is discharged in the direction indicated by the arrow j in FIG. 12 in the card discharging position P4, and engages a card discharging rod 264 and falls onto a card discharging tray 265. The card discharging tray 265 is inclined progressively downwardly from a central position in the casing 37 toward one of the side walls of the casing 37. Therefore, the card KD dropped on the card discharging tray 265 slides down the card discharging tray 265 in the direction j, and is automatically ejected out of the casing 37 through a card ejecting slot (not shown).

Operation of the card printing apparatus will be described below with reference to FIGS. 1 through 6 and also FIGS. 8 through 12. The host computer 14 and the interface cable 16 are omitted from illustration in some of these figures.

The card stage 22 is fed upstream in the direction b from the position shown in FIG. 1 by the belt 35. At this time, no card KD is placed on the card stage 22. Actually, the card stage 22 from which the card KD has been discharged in the card discharging position P4 (see FIG. 12) is first fed downstream in the direction a, then returned to the original position P1, and fed again in the direction b from the original position P1. The guide pin 205*d* of the card installing arm 205 is now displaced in the direction i (see FIG. 10) along the curved configuration of the guide rail 226.

Figure 3:
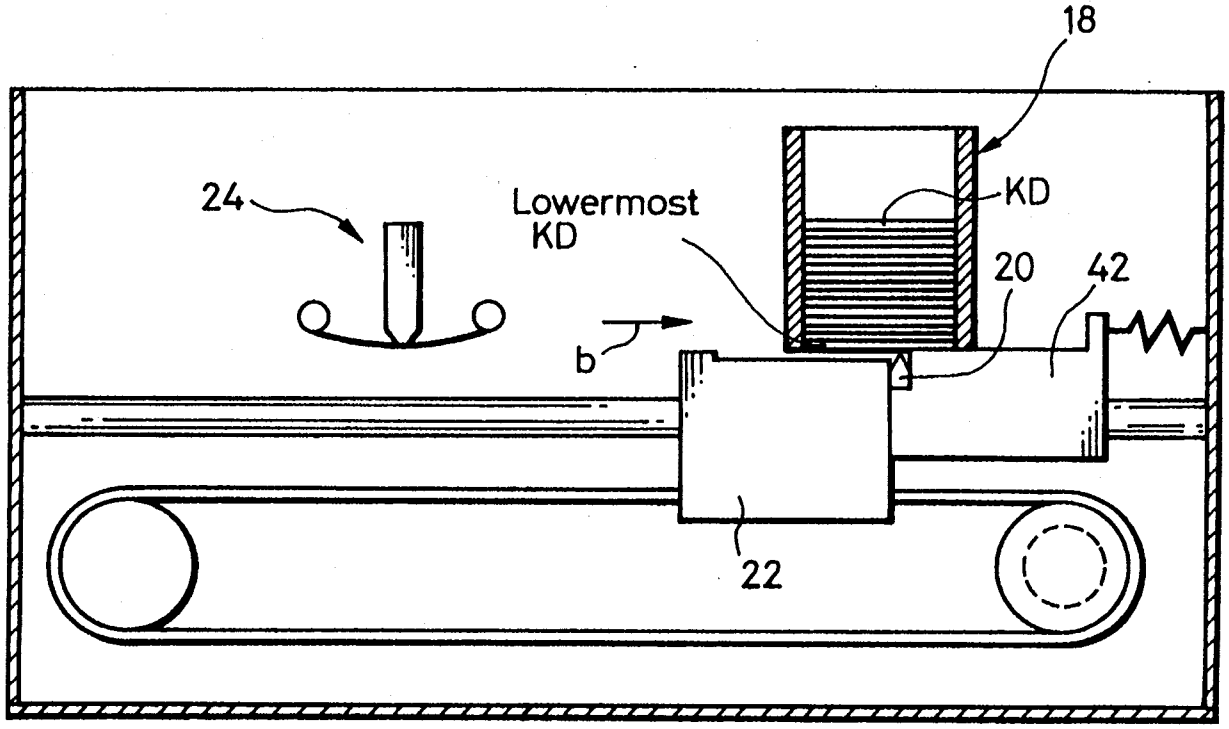
FIG. 3 is a sectional side elevational view of a portion of the card printing apparatus shown in FIG. 1, illustrative of the manner in which ID information is being read from a card by a magnetic head.

Then, as shown in FIG. 3, the upstream end of the card stage 22 abuts against the downstream end of the slider 42, and then is fed further upstream. The slider 42 is now moved upstream in unison with the card stage 22. The magnetic head 20 slides against the lower surface (reverse side) of the lowermost card KD in the card stock unit 18 (see also FIG. 4A). However, the magnetic head 20 may move out of contact with the reverse side of the lowermost card KD.

Figure 4A:
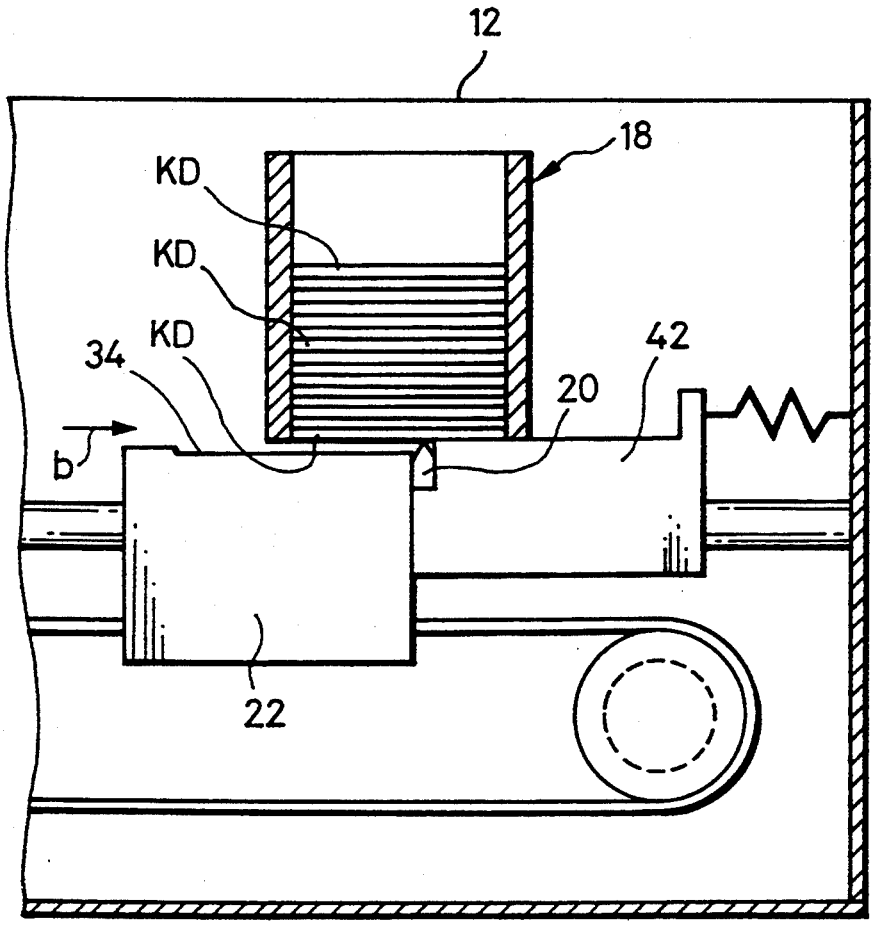
FIG. 4A is an enlarged fragmentary sectional side elevational view of the card printing apparatus shown in FIG. 3.
Figure 4B:
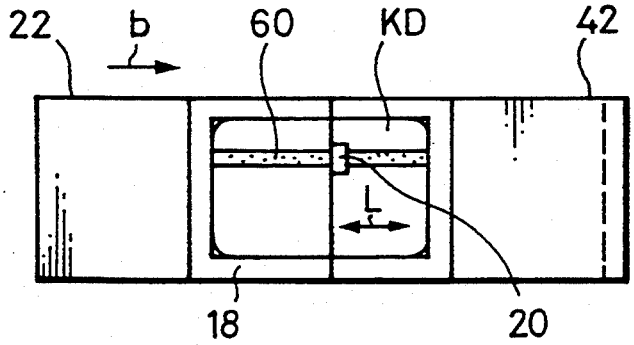
FIG. 4B is a bottom view of a portion of the card printing apparatus shown in FIG. 3.

As shown in FIG. 4B, the reverse side of the card KD has a magnetic stripe 60, shown stippled, serving as an information recording area where the ID information S2 is magnetically recorded, the magnetic stripe 60 extending parallel to the length L of the card KD. Actually, the magnetic stripe 60 is invisible to the human eye. The length of the magnetic stripe 60, i.e., the direction in which the ID information S2 is magnetically recorded continuously, is aligned with the length L of the card KD. If the card KD is a company employee ID card, then the ID information S2 includes the name of a company, an employee serial number, the name of an employee, the password number of the employee, the date of issue of the card, the number of times that the card is issued, the card number, and information check codes for checking these items of information. The ID information S2 is recorded by a magnetic encoder (not shown) as being different from ID information recorded on other cards. The card KD is not limited to a company employee ID card, but may be used as another ID card such as a bank card, a credit card, or the like.

In this embodiment, the ID information S2 is magnetically recorded on the card KD by the non-illustrated magnetic encoder. However, the ID information S2 may be optically recorded as bar-code information or pit information that is typically employed on optical disks. To record the ID information S2 as optical information, an optical head may be used instead of the magnetic head 20.

As shown in FIGS. 4A and 4B, as the card stage 22 moves upstream in the direction b, the ID information S2 recorded in the magnetic stripe 60 is successively read by the magnetic head 20. The ID information S2 thus read is then decoded by the microcomputer 102, and then supplied to the computer unit 26 of the host computer 14 through the interface cable 16.

When the card base 34 of the card stage 22 is fed to a position where it confronts substantially fully the reverse side of the lowermost card KD in the card stock unit 18, all the ID information S2 recorded in the magnetic stripe 60 is fully read by the magnetic head 20. If the magnetic stripe 60 is scanned line by line by the magnetic head 20, then binary signals "0" and "1" may be written in the magnetic stripe 60, and the magnetic head 20 may be of a simple arrangement employing a Hall-effect device, a magnetoresistance device, or the like. As can be seen from FIGS. 4A and 4B, the magnetic head 20 may be mounted on the upstream end of the card stage 22 rather than on the downstream end of the slider 42.

Figure 5:
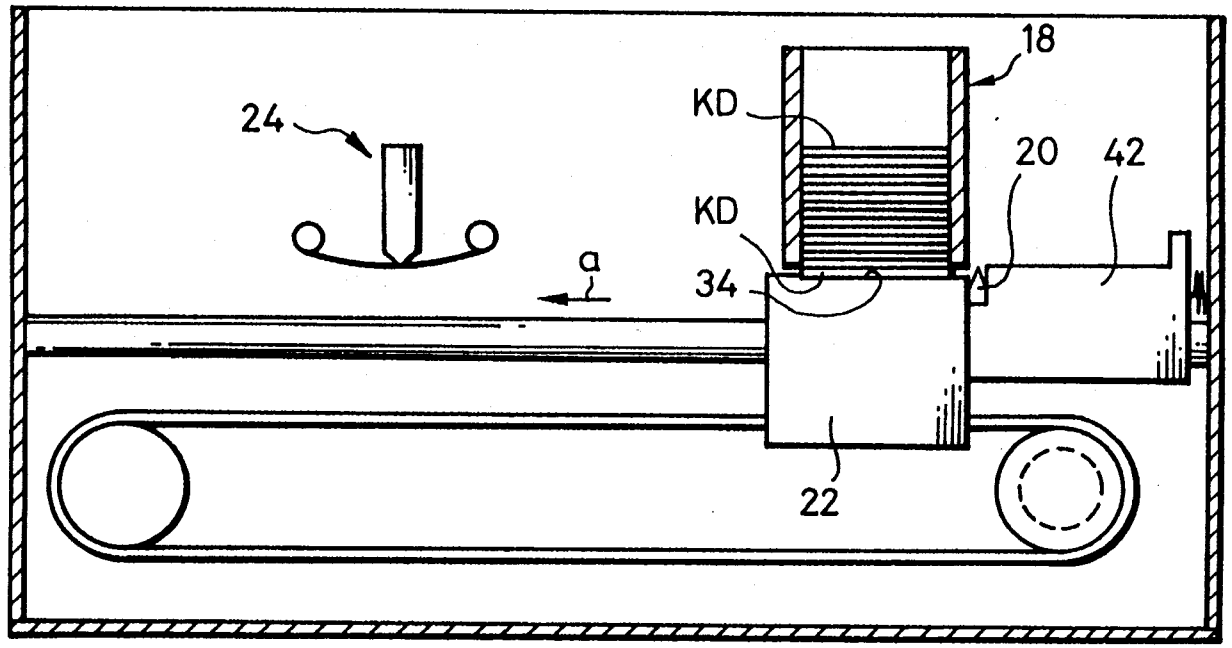
FIG. 5 is a sectional side elevational view similar to FIG. 3, showing the manner in which the ID information has been read from the card by the magnetic head.

FIG. 5 shows the position of the parts when the ID information S2 has fully been read from the card KD by the magnetic head 20.

When the ID information S2 has fully been read, the attributes or the items of information of the lowermost card KD, which is about to be translated toward the printing unit 24 by the card stage 22, have been transmitted through the microcomputer 102 to the host computer 14.

Then, the card stage 22 on which the lowermost card KD from the card stock unit 18 is supported is fed downstream in the direction a is translated to the printing position P3 at the printing unit 24.

FIG. 5 shows the position of the parts when the card stage 22 has been fed to the printing unit 24.

Before the card stage 22 is fed to the printing unit 24, the computer unit 26 (see FIG. 1) has read printing information S1, which comprises image information including photograph and name information corresponding to the ID information S2, from the external storage unit 32, and supplied the printing information S1 through the digital interface 101 and the buffer memory 103 to the image memory 104 (see FIG. 8). In synchronism with the intermittent feeding of the card stage 22 in the directions a, b, the image information stored in the image memory 104 is read under the control of the microcomputer 102 and the memory controller 107. The image information thus read is then processed for $\gamma$ correction and masking (which corrects impurities of reproduced colors). The processed image information is thereafter successively supplied through the thermal head controller 106 to the thermal head 50. The $\gamma$ correction and masking processing may be altered depending on the ID information S2 by the host computer 14 through the microcomputer 102.

Figure 6:
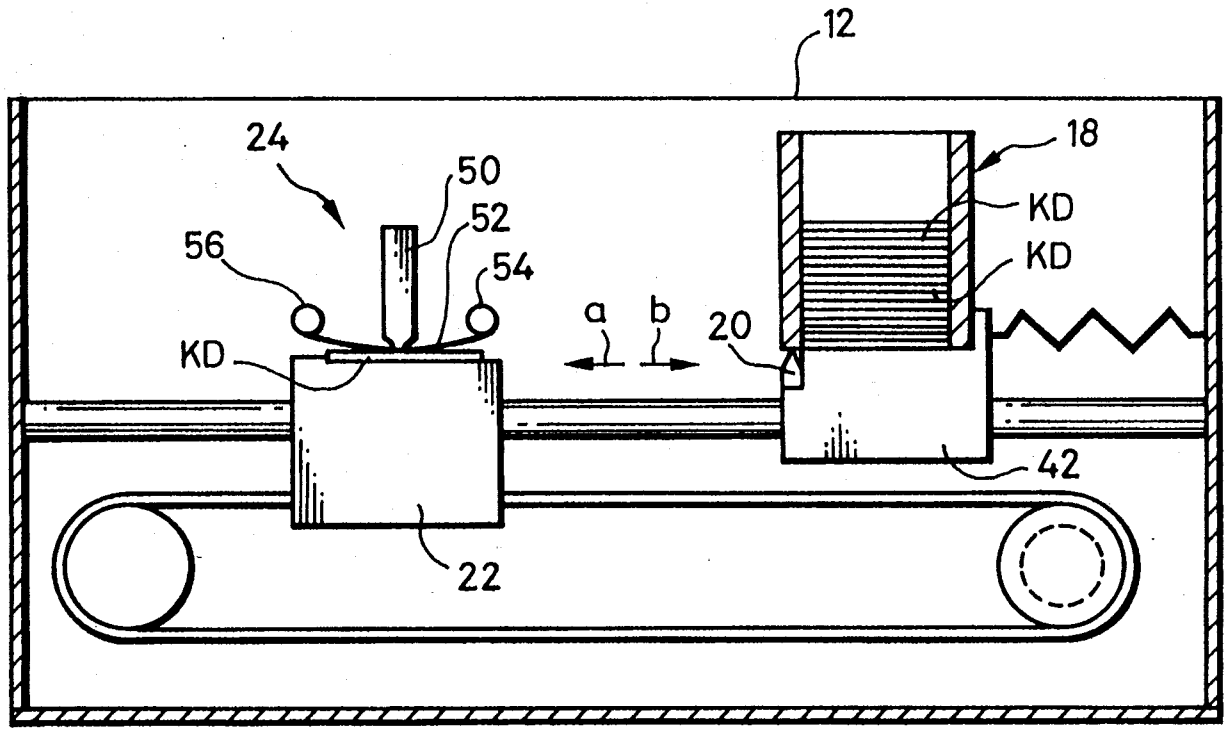
FIG. 6 is a sectional side elevational view showing the manner in which an image is being printed on the card.

In FIG. 6, the card stage 22 with the card KD supported thereon is intermittently moved reciprocally in the directions a, b, and the ink ribbon 52 is intermittently fed from the supply reel 54 to the takeup reel 56 in synchronism with the intermittent reciprocating movement of the card stage 22. Now, the card KD is printed on its upper surface with the photograph of the face of a person and the name of the person in color based on the photograph and name information by the thermal head 50 and the ink ribbon 52.

After the color image has been printed on the card KD, the card stage 22 is fed to the card discharging position P4, and the printed card KD is ejected out of the video printer 12 as described above.

The above sequence of operation from the position shown in FIG. 1 to the position shown in FIG. 6 is repeated to print successive cards KD with respective images. Since the video printer 12 and the host computer 14 are connected to each other, the cards KD stacked in the card stock unit 18 can be printed fully automatically with a complete match ensured between recorded ID information S2 and printed image information.

The image information may be printed not in colors but in black only. If the image information is to be printed in black only, the ink ribbon 52 may be replaced with a monochromatic ink ribbon, and it is not necessary to repeat the intermittent feeding of the card stage 22 during printing. Accordingly, each card KD can be printed in a shorter period of time.

The ID information S2 can be read from the card KD by the magnetic head 20 with higher reliability as follows: When the lowermost card KD is fed from the card stock unit 18 to the printing unit 24, the ID information S2 recorded in the magnetic stripe 60 on a new lowermost card KD in the card stock unit 18 is read by the magnetic head 20 on the card stage 22 as it moves from the position shown in FIG. 5, and stored in the microcomputer 102. After image information is printed on the card KD by the printing unit 24, the printed card KD is discharged from the card stage 22. When the card stages 22 returns to the card stock unit 18, the ID information S2 recorded in the magnetic stripe 60 on the new lowermost card KD in the card stock unit 18 is read again by the magnetic head 20. Therefore, the ID information S2 is read highly reliably as it is read twice.

In this embodiment, when the card KD with the magnetic stripe 60 serving as an information recording area in which the ID information S2 is magnetically recorded is translated to the printing unit 24 by the card stage 22, the ID information S2 is read by the magnetic head 20 on the slider 42 upon movement of the card stage 22. Then, the printing information S1 based on the ID information S2 is supplied from the host computer 14 to the printing unit 24, which prints the information S1 on the card KD from which the ID information S2 has been read immediately before. Consequently, a match between the ID information S2 recorded in the magnetic stripe 60 and the printed image information can reliably be achieved with a simple arrangement.

Figure 7:
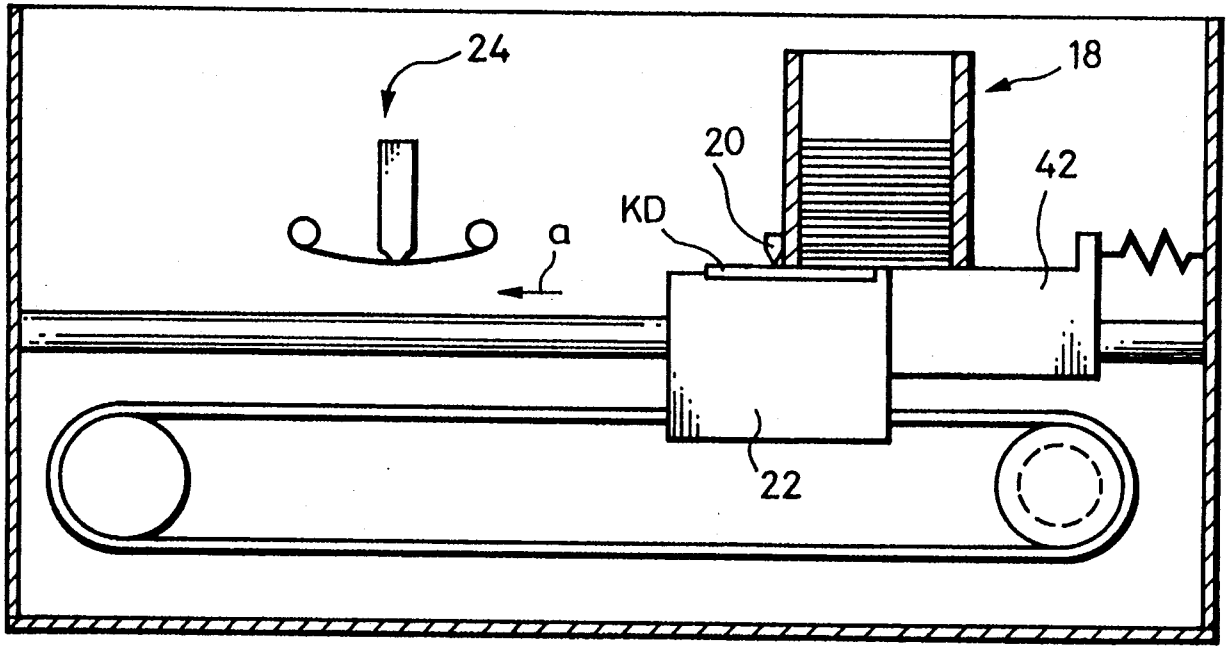
FIG. 7 is a sectional side elevational view of a portion of a card printing apparatus according to another embodiment of the present invention.

FIG. 7 shows a portion of a card printing apparatus according to another embodiment of the present invention. Those parts shown in FIG. 7 which are identical to those of the above embodiment are indicated by identical reference numerals and will not be described in detail below.

The magnetic head 70 for reading the ID information S2 recorded in the magnetic stripe 60 on the magnetic card KD may be moved in the longitudinal direction of the magnetic stripe 60 to read the ID information S2, or the card KD may be moved in the longitudinal direction of the magnetic stripe 60 for the magnetic head 20 which may be fixed in position to read the ID information S2 recorded in the magnetic stripe 60. Stated otherwise, the ID information S2 recorded in the magnetic stripe 60 may be read insofar as the card KD and the magnetic head 20 are moved relatively to each other.

In FIG. 7, the magnetic head 20 is fixed to a downstream side wall of the card stock unit 18, rather than the slider 42. In this embodiment, the magnetic stripe 60 is formed on the upper surface (where image information is to be printed) of the card KD.

According to the embodiment shown in FIG. 7, when the lowermost card KD in the card stock unit 18 is translated downwardly in the direction a toward the printing unit 24 by the card stage 22, the ID information S2 is read from the magnetic stripe 60 by the magnetic head 20. The operation of the card printing apparatus after the ID information S2 has been thus read is the same as the operation of the card printing apparatus according to the above embodiment.

In FIG. 7, the card KD on the card stage 22 is printed with image information based on the ID information S2 which is recorded on the card KD and has been read immediately before the card KD is printed. Therefore, a reliable match between the ID information S2 recorded on the card KD and the image information printed on the card KD can be obtained through a simple arrangement. Furthermore, since the magnetic head 20 is fixed to the card stock unit 18 and hence is not moved, any cable connected to the magnetic head 20 is not moved. Therefore, the card printing apparatus shown in FIG. 7 is more mechanically reliable than the card printing apparatus according to the previous embodiment.

With the features of the present invention, as described above, the reading means is arranged to read ID information recorded in the information recording area of a card upon translation of the reading means relative to the card, and the printing means is arranged to print image information on the card based on the ID information that has been read from the information recording area by the reading means. Therefore, it is possible to achieve, through a simple arrangement, a complete match between the ID information recorded in the information recording area and the image information printed on the card, and hence the card with necessary ID and image information can be produced without errors. The card can also be produced accurately within a short period of time as no human intervention is involved to verify the match.

Furthermore, if the reading means is mounted on the slider or the card stage, then the ID information recorded in the information recording area of the card can be read twice upon reciprocating movement below the card stock means of the reading means that is moved in unison with the slider or the card stage. As a result, the ID information can be read highly reliably.

If the reading means is attached to the card stock means, then since the reading means is fixed in position, any cable by which the reading means is connected to a controller, e.g., the microcomputer, is not moved around. As a consequence, the card printing apparatus has improved mechanical reliability.

If the printing means comprises a thermal transfer head, then the printing means is of a simpler structure, making the card printing apparatus less expensive, than a laser printer that requires toner replacement.

If the image information to be printed on the card is at least the photograph of the face of a person and the name of the person, then it is possible to produce an ID card which has the printed photograph of the face and the printed name in addition to the recorded ID information.

Furthermore, the information recording area is in the shape of a stripe and the card is fed in the longitudinal direction of the stripe by the card stage. Thus, the reading means is relatively simple in arrangement.

If the ID information recorded in the information recording area is magnetic information, then it is possible to produce a magnetic ID card.

If the ID information recorded in the information recording area is optical information in the form of a pit information or bar-code information, then it is possible to produce an optical ID card.

Having described preferred embodiments of the invention with reference to the accompanying drawings, it is to be understood that the invention is not limited to those precise embodiments and that various changes and modifications could be effected by one skilled in the art without departing from the spirit or scope of the invention as defined in the appended claims.

What is claimed is:

1. A card printing apparatus for printing image information on a surface of a card, comprising:

a card stage for supporting the card on an upper surface thereof;

card stock means for stocking a vertical stack of cards;

feeding means for feeding said card stage at least between a first position wherein a card is withdrawn from the bottom of said stack of cards in said card stock means, and a second position wherein the image information is printed on the surface of the card, said first and second positions being located along a first straight path parallel to the surface of the card;

withdrawing means responsive to the feeding of said card stage to said first position and ,for withdrawing a card from said card stock means onto said card stage;

a slider which is associated with said card stock means and which is movable along a second straight path that is aligned with the first straight path, said slider normally supporting a lowermost one of the cards in said card stock means while said card stage is in said second position, said slider being displaceable in said second direction when said card stage moves to said first position;

reading means responsive to the feeding of said card stage for reading information recorded on the card which is withdrawn from said stock means when said card stage is one of moving from said second position into said first position and moving out of said first position toward said second position, said reading means being disposed on one of said card stage, said card stock means, and said slider; and printing means responsive to the feeding of said card stage to said second position for printing the image information on the surface of the cards supported on said card stage based on the information read from said one of the cards by said reading means.

2. A card printing apparatus according to claim 1, wherein said printing means comprises a thermal transfer head.

3. A card printing apparatus according to claim 1, wherein said reading means comprises means for reading information recorded on a lowermost one of the vertical stack of cards.

4. A card printing apparatus according to claim 3, wherein said reading means comprises a magnetic head.

5. A card printing apparatus according to claim 1, wherein said reading means is immovably supported on said one of said card stage, said card stock means, and said slider.

6. A card printing apparatus comprising:

storage means for storing a vertical stack of cards;

a slider associated with said storage means, said slider being laterally movable within said printing apparatus along a first horizontal linear path, said slider being biased to normally assume a position immediately below said storage means wherein it closes the bottom of said storage means and supports a lowermost card of said stack of cards;

a printing head;

a card stage which is movable along a second horizontal linear path which is aligned with said first linear path, said card stage supporting a card from said storage means and transporting the card from said storage means to said printing head, said card stage being engageable with said slider and movable to a position below said storage means wherein a card from said storage means can be transferred thereto and wherein said slider is displaced from below said storage means to one side of said storage means; and reading means for reading information recorded on the card when relative movement between said reading means and the card is induced by movement of said card stage relative to said storage means, said reading means being supported on one of said storage means, said slider and said card stage so that when a card is transferred to said card stage relative movement between said card and said reading means occurs which allows the recorded information to be read.

7. A card printing apparatus according to claim 6, wherein said reading means is immovably supported on said one of said storage means, said slider and said card stage.

8. A card printing apparatus comprising:

storage means for storing a vertical stack of cards, said storage means including a card stock unit comprised of a vertically oriented rectangular frame with an open bottom;

a slider associated with said storage means, said slider being laterally movable within said printing apparatus along a first horizontal linear path, said slider being biased to normally assume a position immediately below said rectangular frame wherein it closes the open bottom of said rectangular frame and supports a lowermost card of said stack of cards disposed in said rectangular frame;

a printing head;

a card stage which is movable along a second horizontal linear path which is aligned with said first linear path, said card stage supporting a card from said storage means and transporting the card from said storage means to said printing head, said card stage being engageable with said slider and movable to a position below said rectangular frame wherein a card from within said rectangular frame can be transferred onto said card frame and wherein said slider is displaced from below said rectangular frame to a side of said rectangular frame distal from said printing head; and a magnetic head for reading information recorded on the card when relative movement between said reading means and the card is induced by movement of said card stage relative to said storage means, said magnetic head being supported on said rectangular frame and positioned such that as a card which is supported on said card stage passes out from below said rectangular frame, magnetic data recorded on the card can be read by said magnetic head and transferred to said printing head in a manner to control printing on the card.

9. A card printing apparatus according to claim 8, wherein said magnetic head is immovably connected to said rectangular frame.

10. A card printing apparatus for printing a first information on a card based on a second information recorded on the card, comprising:

card stock means for storing a vertical stack of cards;

a slider associated with said card stock means, said slider being movable along a first horizontal linear path, said slider being biased to assume a position below said card stock means wherein it supports a lowermost card of said vertical stack of cards;

printing means spaced from said card stock means for printing first information on a card;

card carriage means movable along a second horizontal linear path which is aligned with said first linear path, for carrying a card from said card stock means to said printing means, said card carriage being abuttable with said slider and movable to a position below said card stock means wherein a card from said card stock means can be transferred thereto and wherein said slider is displaced from below said card stock means;

card withdrawing means associated with said card carriage means and responsive to movement of said card carriage means to the position below said card stock means for withdrawing one card at a time from said card stock means onto said card carriage means;

reading means for reading a second information recorded on a card which is one of in the process of being withdrawn and has been withdrawn onto said card carriage means when relative movement between said reading means and the card which is withdrawn from the stack of cards in said card stock means, is induced by the movement of said card carriage means relative to said card stock means; and control means for supplying second information read from said one of the cards to said printing means and controlling said printing means to print first information on said one of the cards on said card carriage means based on second information read from said one of the cards.

11. A card printing apparatus according to claim 10, wherein said first information comprises image information and said second information comprises information magnetically recorded on the cards.

12. A card printing apparatus according to claim 10, wherein said printing means comprises a thermal transfer head.

13. A card printing apparatus comprising:

storage means for storing a vertical stack of cards, said storage means including a card stock unit comprised of a vertically oriented rectangular frame with an open bottom;

a slider associated with said storage means, said slider being laterally movable within said printing apparatus along a first horizontal linear path, said slider being biased to normally assume a position immediately below said rectangular frame wherein it closes the open bottom of said rectangular frame and supports a lowermost card of said stack of cards disposed in said rectangular frame;

a printing head;

a card stage which is movable along a second horizontal linear path which is aligned with said first linear path, said card stage supporting a card from said storage means and transporting the card from said storage means to said printing head, said card stage being engageable with said slider and movable to a position below said rectangular frame wherein a card from within said rectangular frame can be transferred onto said card frame and wherein said slider is displaced from below said rectangular frame to a side of said rectangular frame distal from said printing head; and a magnetic head for reading information recorded on the card when relative movement between said reading means and the card is induced by movement of said card stage relative to said storage means, said magnetic head being supported on said slider proximate an edge of said slider engaged by said card stage such that information recorded on a lowermost card of the vertical stack of cards which is about to be transferred to said card stage, is read as said slider is displaced from the position below said rectangular frame to the position wherein a card can be transferred to said card stage.

14. A card printing apparatus according to claim 13, wherein said magnetic head is immovably connected to said slider.

15. A card printing apparatus comprising:

storage means for storing a vertical stack of cards, said storage means including a card stock unit comprised of a vertically oriented rectangular frame with an open bottom;

a slider associated with said storage means, said slider being laterally movable within said printing apparatus along a first horizontal linear path, said slider being biased to normally assume a position immediately below said rectangular frame wherein it closes the open bottom of said rectangular frame and supports a lowermost card of said stack of cards disposed in said rectangular frame;

a printing head;

a card stage which is movable along a second horizontal linear path which is aligned with said first linear path, said card stage supporting a card from said storage means and transporting the card from said storage means to said printing head, said card stage being engageable with said slider and movable to a position below said rectangular frame wherein a card from within said rectangular frame can be transferred onto said card frame and wherein said slider is displaced from below said rectangular frame to a side of said rectangular frame distal from said printing head; and a magnetic head for reading information recorded on the card when relative movement between said reading means and the card is induced by movement of said card stage relative to said storage means, said magnetic head being supported on said card stage proximate an edge which engages said slider such that information recorded on a lowermost card of the vertical stack of cards which is about to be transferred to said card stage, is read as said card stage moves below said rectangular frame and said slider is displaced from the position below said rectangular frame to the position wherein a card can be transferred to said card stage.

16. A card printing apparatus according to claim 15, wherein said magnetic head is immovably connected to said card stage.

* * * * *